United States Patent [19]

Adelberg

[11] 4,124,240

[45] Nov. 7, 1978

[54] AUTO TRUNK LID HOLDER

[76] Inventor: Roy Adelberg, 430 Fisher Rd., Grosse Pointe Farms, Mich. 48236

[21] Appl. No.: 719,594

[22] Filed: Sep. 1, 1976

[51] Int. Cl.[2] ..... E05C 17/04

[52] U.S. Cl. ..... 292/262; 248/351; 292/288; 292/339

[58] Field of Search ..... 248/351, 226.1; 217/61; 290/76; 292/258, 288, 339, 262

[56] References Cited

U.S. PATENT DOCUMENTS

| | | | |
|---|---|---|---|
| 268,616 | 12/1882 | Brown | 248/226.1 X |
| 401,553 | 4/1889 | Godfrey | 248/226.1 X |
| 628,031 | 7/1899 | Parker | 217/61 |
| 739,563 | 9/1903 | Shade | 217/61 |
| 849,138 | 4/1907 | Kraus | 248/226.1 |
| 2,974,989 | 3/1961 | Hilbers | 248/351 X |
| 3,180,668 | 4/1965 | Brown | 292/258 X |
| 3,216,605 | 11/1965 | Hughes | 217/61 |

*Primary Examiner*—William H. Schultz
*Attorney, Agent, or Firm*—A. W. Breiner

[57] ABSTRACT

An automobile trunk lid holder comprising a rod with an engagement means at each end capable of gripping in opposing directions and an offset intermediate therebetween, wherein the offset means allows one of the engagement means to engage the trunk lid with a gripping action and further allows the other engagement means to engage the trunk lid frame with a gripping action in a direction generally opposite to that of the first engagement means.

1 Claim, 8 Drawing Figures

AUTO TRUNK LID HOLDER

The invention relates to a device of the type designed for holding a compartment lid, particularly the truck lid of an automobile in a partially open position.

It is well-known that occasionally something has to be carried in the trunk of a car which is too large or bulky to permit the complete closing of the trunk lid. So as to prevent the, mostly spring-biased, trunk lid from opening all the way and thereby impeding the view of the driver, it is customary to use a piece of string, rope, wire or a coil spring, the ends of which are slid through holes or fastened to projections of the car body and of the lid. This is, however, very awkward and unsatisfactory. Holes for the rope or the like are often hard to find or nonexistent or they may be covered by the bulky object located in the trunk. The holes, such as cut-outs, mostly have sharp, ragged edges which cut through the string or rope after a relatively short drive. An important additional shortcoming of these known expedients is that the lid, so as to prevent it from flapping up and down, has to be fully and firmly pressed down onto the object in the trunk compartment; this is often undesirable or even prohibitive because in doing so, the object in the trunk may be scratched or otherwise damaged, for instance be bent or broken.

A further shortcoming of these expedients is the tendency of the truck lid to be sprung when held open under tension without proper support.

In most instances there are no reliable easy to install devices commercially available for supporting a trunk lid which do not interfere with the maximum loading capacity of said trunk and which devices can be readily stored inside the trunk when not in use.

The object of the invention is not only to overcome the aforesaid shortcomings of known devices but to achieve additional advantages and to provide a novel holder believed to be applicable to all or nearly all constructions of trunks and trunk lids now in use, without requiring any changes or other adaptations.

The aforesaid and other objects and advantages are achieved in accordance with the invention by means of a rigid rod having engagement means at each end which are capable of gripping in opposing directions and an intermediate said engagement means an offset means. The first engagement means is adapted to releasably grip a margin of the trunk lid by means of a quick acting clamp while the second engagement means is adapted to releasably grip the channel of the lid frame such that when the lid is held in the open position at least part of the weight of the lid is transferred to the channel of the lid frame.

More specifically, the first engagement means which grips the trunk lid comprises a quick acting clamp which is rotably secured to the rod. The clamp is actuated by a cam handle and is adapted for releasably gripping a margin of the trunk lid. The second engagement means which grips the trunk lid frame and accordingly grips in a direction generally opposing that of said first engagement means comprises a clamp, one face of which is lengthwise adjustably secured to the rod, and a second face of which comprises the end of the rod. The adjustable face is adapted to engage the channel of the lid frame while the opposing face engages the underside of the lid frame. The faces of this clamp can be so arranged, depending on frame design, that they achieve gripping action irrespective of the relative position of each. This allows the engagement means to be adaptable to most configurations.

The lengthwise adjustability of one clamp of the second engagement means provides a self-adjusting feature and allows the second engagement means to be secured to the lid frame at various locations along the perimeter of the lid thereby permitting the lid to be held in various positions from almost shut to 90% open. For example, as the holder is placed close to the lid hinges it approaches a more open condition. Preferably when the trunk lid is to be held open more than halfway, two lid holders are employed, one on each side to avoid undo stress on the lid itself and the hinges.

Further objects, advantages and features of the invention as well as specific advantageous details thereof will be more fully disclosed by the following description of one embodiment of the invention and by the illustration thereof in the attached drawing.

Figure 1:
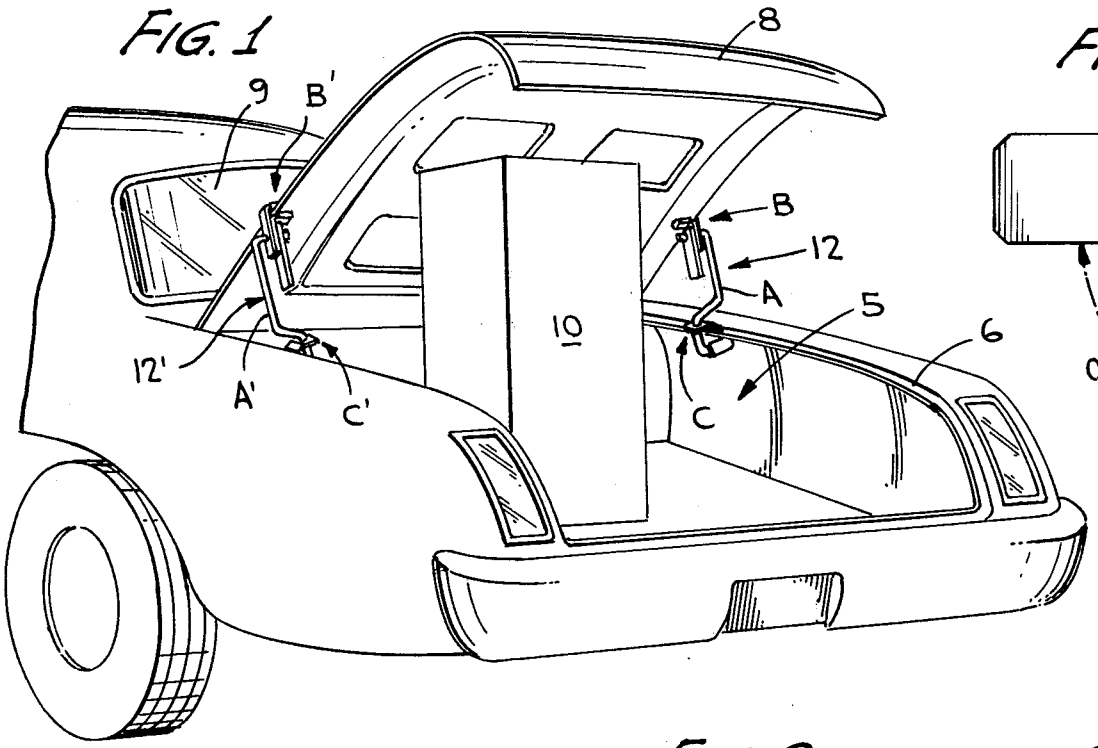
FIG. 1 is a fragmentary, diagrammatic, small three-quarter rear view of an automobile having its trunk lid held in fully open position by the novel holder.

The automobile shown in FIG. 1 comprises a trunk compartment 5 having an opening surrounded by stationary trunk lid frame 6, a trunk lid 8 and a rear window 9. Shown within the compartment 5 is a large box 10. For accommodating the box 10 within the compartment, the lid 8 has to be held in the position shown in FIG. 1 so that on the one hand the lid will not press on the object and on the other hand will not be raised by the customary balancing springs (not shown) to a completely open position.

Figure 2:
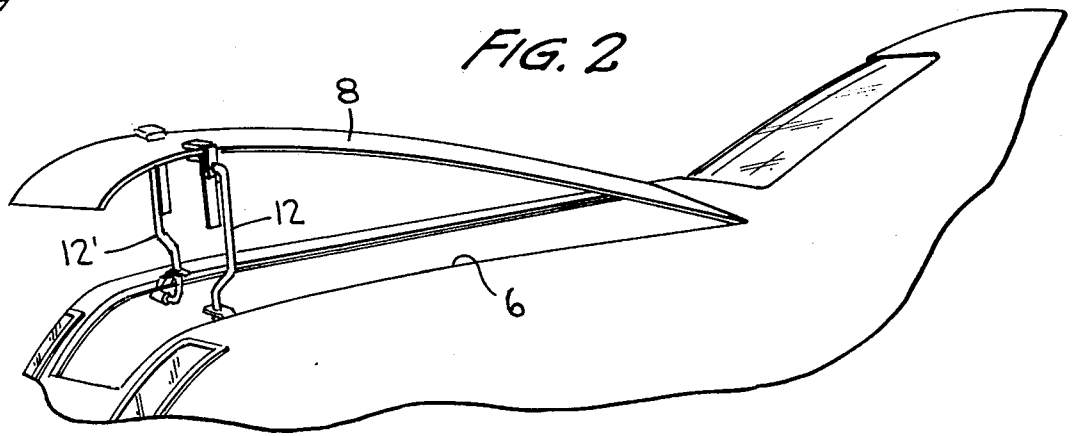
FIG. 2 is a fragmentary, diagrammatic, small side view of an automobile having its trunk lid held in the minimum open position, with the novel holder at the lower extremity of the trunk frame.
Figure 3:
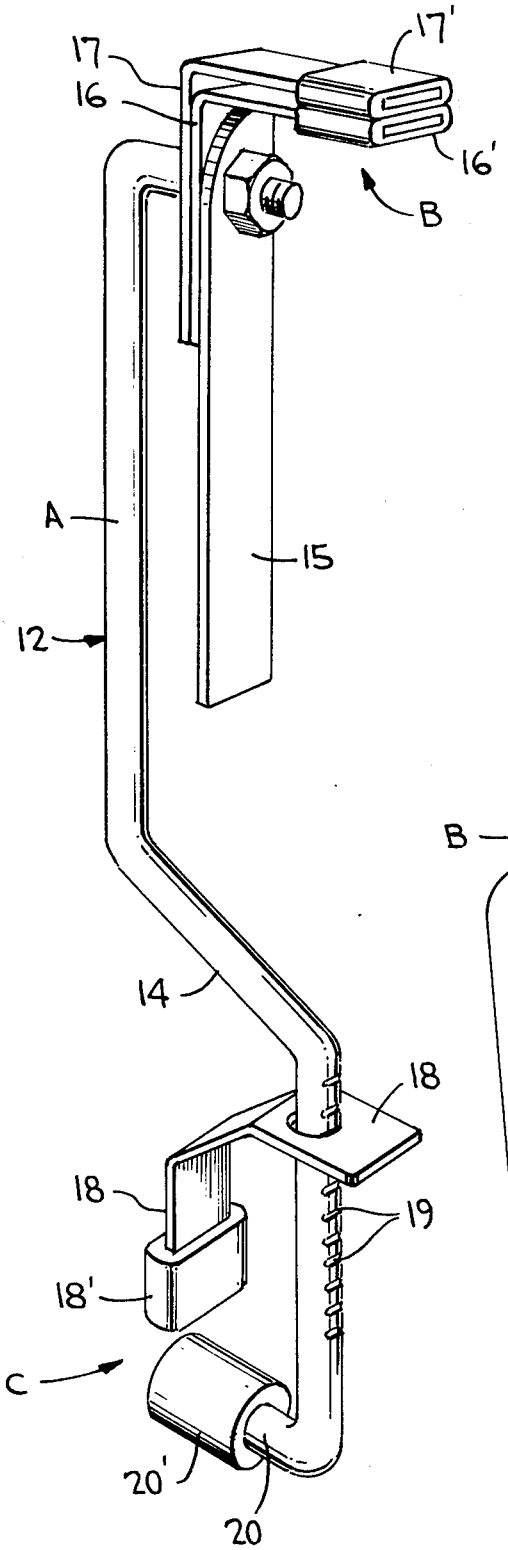
FIG. 3 is a perspective view showing the novel holder on a substantially larger scale than FIG. 1 with the handle of the first engagement means in closed position and the self-adjusting feature of the second engagement means is illustrated.

For securely and stationarily holding lid 8 as shown or in any other partly open position, holders 12 and 12' are provided which are diagrammatically shown in FIGS. 1 and 2 and the details of which are illustrated in FIGS. 3 to 8.

The main elements of these holders 12 and 12' are a rod A and A' and engagement means B,B',C and C'.

Referring to FIG. 2, trunk lid 8 is shown in a minimum open secured position with trunk holders 12 and 12' located at the maximum distance from the lid hinges (not shown) at the lower most extremity of the lid frame.

Figure 6:
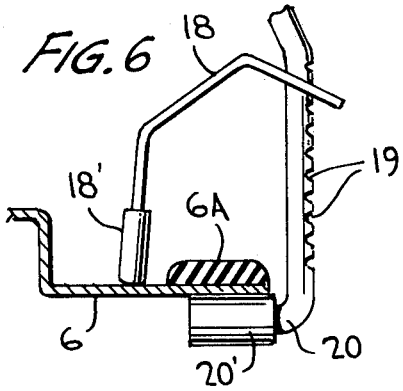
FIG. 6 is a fragmentary side elevation view of the self-adjusting second engagement means secured to the trunk lid frame.
Figure 7:
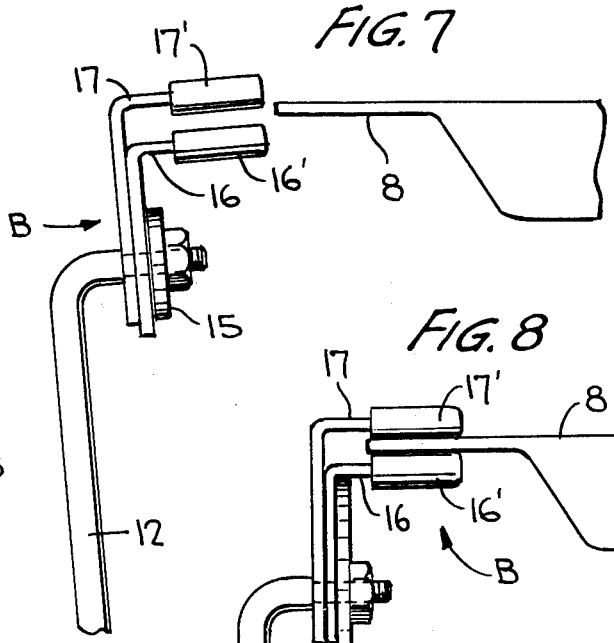
FIG. 7 is a fragmentary side elevation view of the first engagement means prior to engaging the lid.
Figure 8:
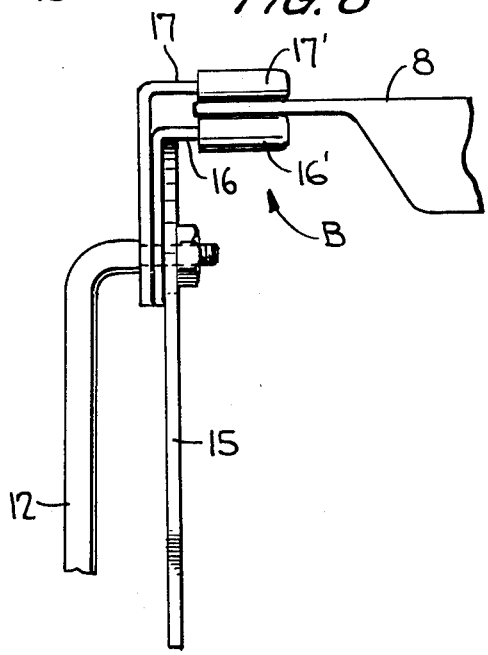
FIG. 8 is a fragmentary side elevation view of the first engagement means secured to the trunk lid.

Referring to FIGS. 3 to 8, lid holder 12 comprises Rod A with opposing engagement means B and C and intermediate therebetween offset means 14. Engagement means B is provided with handle means 15. Handle means 15 engages clamp element 16 of engagement means B. Clamp element 16 in conjunction with clamp element 17 allows for the engagement of trunk lid 8 when the cam actuated handle is placed in the closed position as shown in FIG. 8. It is preferable that clamp elements 16 and 17 be provided with elastomeric members 16' and 17' to avoid scratching the surface of lid 8.

Figure 4:
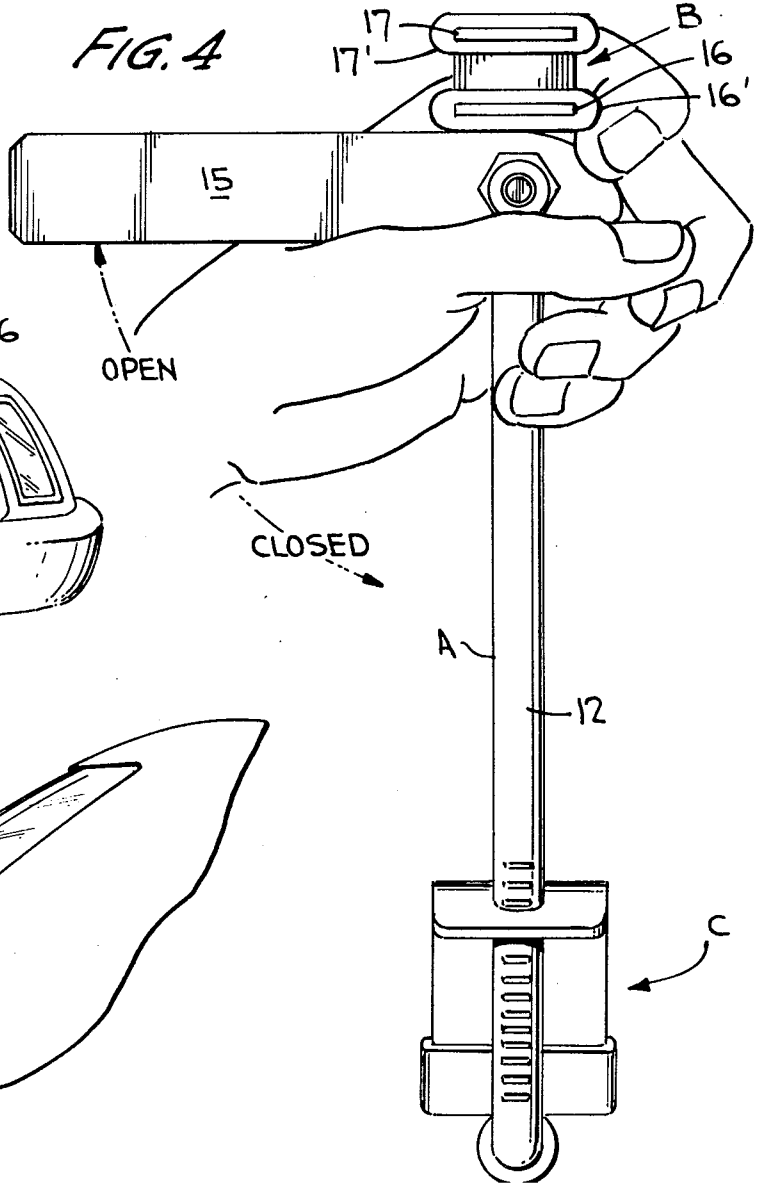
FIG. 4 is a front elevation view of the novel holder with the handle of the first engagement means in the open position.

Referring to FIGS. 7 and 8, when handle 15 is rotated the cam releases from clamp element 16 and allows the clamp members 16 and 17 to separate as shown in FIG. 4. The clamp elements 16 and 17 can then be adapted to engage a margin of the lid 8 as shown in FIG. 7.

Figure 5:
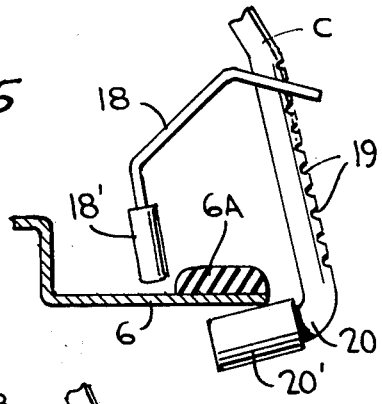
FIG. 5 is a fragmentary side elevation view of the second engagement means engaging the trunk lid frame, with one clamp member resting in the channel exterior to the weatherstrip and the second clamp member hooked under the edge of the trunk frame.

Referring to FIG. 5, clamp element 18 of engagement means C is lengthwise adjustably secured to rod A. This adjustability can be obtained by means of teeth 19 or alternatively by a friction fit (not shown). This lengthwise adjustability of clamp member 18 provides engagement means C with the capability of being self-adjusting. Thus, it can be appreciated that the relative positions of members 18 and 20 can range from the position shown in FIGS. 5 and 6 to one where member 18 is substantially below 20.

Clamp element 20 of engagement means C comprises the end of rod A. Clamps 18 and 20 respectively are preferably provided with elastomeric sheaths 18' and 20'. When rod A is placed vertical to trunk lid channel 6, clamp elements 18 and 20 grip channel 6 as shown in FIG. 6. That is, clamp member 18 rests in the channel exterior to weatherstripping 6A while clamp member 20 hooks under the edge of trunk frame 6.

Rod A is offset intermediate engagement means B and C to allow for the opposing gripping of engagement means B and C respectively. Offset means 14 also allows for the free movement of handle 15 from open to closed position, while providing bracing and support for trunk lid 8.

The clamps B and C are, as visible from FIGS. 3–8, adapted to engage in opposing directions marginal portions of the compartment opening enclosure 6 and lid 8 respectively. Self-adjusting clamp C engages by its parts 18 and 20 the water drainage and reinforcing channel 6 while parts 16 and 17 of upper engagement means B engages by its corresponding parts the outwardly projecting overlap flange or portion of lid 8. The resilient or soft coverings 16',17'18' and 20' prevent marring or other damage of the body or lid portions engaged by the clamps.

Once engaging means C is in place and rod A is moved to a vertical position, the cocked self-adjusting clamp 18 is forced into a tight grip on channel 6. Thus, when engagement means B is locked onto lid 8 by means of handle 15, the two opposing engagement means in cooperation with offset means 14, produce complimentary forces which assure optimum gripping of the lid and frame respectively.

The margins of compartment openings (trunk as well as motor compartments) are in present-day automobiles universally formed as shown in the drawing or very similar thereto. Consequently, the new holder can be used in connection with any present-day automobile or at least approximately so. It may be mentioned here that occasionally it may be desirable to use the new holder for the motor compartment so as to keep the lid in open position during driving or to prevent it from being blown down by strong winds when working on the motor.

It is easily understood that the angular adjustability of the clamps relative to the rod permits the clamps to be turned to any possible angular position of the parts of compartment and lid to be engaged by them. It also permits any angular position of the rod itself in case a particular angular position should be necessary to bypass outwardly projecting contents of the trunk compartment.

It is furthermore obvious from the drawing and from the foregoing specification that the new holder holds the trunk lid firmly in any desired position without the latter being able to flap up or down and without the danger of the holder giving away.

The invention is not restricted to the illustrated and described embodiments or details thereof but is susceptible to simplifications, modifications and adaptations.

What is claimed is:

1. An automobile trunk lid holder comprising a substantially rigid single rod having first and second ends and an offset portion therebetween, a first engagement means at the first end of said rod for releasably gripping the margin of a trunk lid and a second engagement means at the second end of said rod for releasably gripping the channel of a trunk lid frame so as to hold the trunk lid in the open position, said first engagement means being rotatably secured to said first rod ends and having clamp means including a fixed member and a movable member and handle actuated cam means for actuating said clamp means to releasably lock said clamp means to the margin of the trunk lid by movement of said handle, said second engagement means including an arm which is lengthwise adjustably secured to said rod adjacent said second rod end to accommodate the trunk lid frame, said arm having two bends dividing said arm into first and second terminal portions, said first terminal portion being apertured and receiving said rod and said second terminal portion having a free end generally opposing said second rod end with said arm and said second rod end cooperating to provide a lever and fulcrum combination when in engagement with the trunk lid frame, said first and second engagement means in cooperation with said offset means producing complementary forces assuring optimum gripping of the lid and frame.

* * * * *